US006808414B2

(12) United States Patent
Spiegel et al.

(10) Patent No.: US 6,808,414 B2
(45) **Date of Patent: *Oct. 26, 2004**

(54) MODULAR SHIELDED CONNECTOR

(75) Inventors: Marko Spiegel, LaFox, IL (US); David E. Dunham, Aurora, IL (US); Victor Zaderej, St. Charles, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/275,516

(22) PCT Filed: May 4, 2001

(86) PCT No.: PCT/US01/14512

§ 371 (c)(1),
(2), (4) Date: Nov. 5, 2002

(87) PCT Pub. No.: WO01/86759

PCT Pub. Date: Nov. 15, 2001

(65) Prior Publication Data

US 2003/0203677 A1 Oct. 30, 2003

Related U.S. Application Data

(63) Continuation-in-part of application No. 09/565,705, filed on May 5, 2000, now Pat. No. 6,491,545.

(51) Int. Cl.[7] ..... H01R 13/648
(52) U.S. Cl. ..... 439/579; 439/608; 439/931
(58) Field of Search ..... 439/579, 608, 439/931

(56) References Cited

U.S. PATENT DOCUMENTS

| | | | | |
|---|---|---|---|---|
| 4,921,453 | A | | 5/1990 | O'Brien |
| 4,969,827 | A | | 11/1990 | Hahs, Jr. |
| 4,969,842 | A | | 11/1990 | Davis |
| 5,028,492 | A | | 7/1991 | Guenin |
| 5,061,198 | A | | 10/1991 | Manabe et al. |
| 5,066,236 | A | * | 11/1991 | Broeksteeg |
| 5,167,531 | A | * | 12/1992 | Broschard et al. |
| 5,173,056 | A | * | 12/1992 | Kniese et al. |
| 5,281,762 | A | * | 1/1994 | Long et al. |
| 5,344,341 | A | | 9/1994 | Yoshino |
| 5,354,219 | A | | 10/1994 | Wanjura |
| 5,387,114 | A | * | 2/1995 | Brunker et al. |
| 5,439,385 | A | * | 8/1995 | Sakai et al. |
| 5,522,727 | A | * | 6/1996 | Saito et al. |
| 5,599,595 | A | | 2/1997 | McGinley et al. |
| 5,626,483 | A | | 5/1997 | Naitoh |
| 5,674,077 | A | * | 10/1997 | Flaig et al. |
| 5,688,146 | A | | 11/1997 | McGinley et al. |
| 5,727,956 | A | | 3/1998 | Mitra et al. |
| 5,842,872 | A | * | 12/1998 | Hosler et al. |
| 5,943,770 | A | * | 8/1999 | Thenaisie et al. |
| 5,997,358 | A | | 12/1999 | Adriaenssens et al. |
| 6,375,512 | B1 | | 4/2002 | Zito et al. |
| 6,491,545 | B1 | | 12/2002 | Spiegel et al. |
| 6,494,734 | B1 | * | 12/2002 | Shuey |
| 6,551,140 | B2 | * | 4/2003 | Billman et al. |
| 6,702,590 | B2 | | 3/2004 | Zaderej et al. |
| 6,712,646 | B2 | * | 3/2004 | Shindo |

| | | |
|---|---|---|
| 439/614 | | |
| 439/293 | | |
| 439/79 | | |
| 439/541.5 | | |
| 439/79 | | |
| 174/78 | | |
| 439/607 | | |
| 439/608 | | |
| 439/108 | | |
| 439/79 | | |
| 439/65 | | |
| 439/33 | | |
| 439/74 | | |
| 439/63 | | |
| 439/637 | | |
| 439/74 | | |
| 439/63 | | |
| 29/883 | | |
| 439/676 | | |
| 439/660 | | |
| 439/579 | | |
| 439/378 | | |
| 439/608 | | |
| 439/74 | | |
| 439/608 | | |

FOREIGN PATENT DOCUMENTS

| | | |
|---|---|---|
| EP | 0 510 995 A2 | 10/1992 |
| EP | 0693 795 A1 | 1/1996 |
| GB | 2 312 566 A | 10/1997 |

* cited by examiner

*Primary Examiner*—Gary Paumen
(74) *Attorney, Agent, or Firm*—Robert J. Zeitler

(57) ABSTRACT

A modular connector includes at least a pair of dielectric housing modules defining at least one conductor-receiving passage therebetween. The passage is split axially whereby a passage portion is disposed in each housing module. The housing modules are plated with conductive shielding material at least in the area of the split passage. A conductor, for example, a coaxial cable section or a differential signal pair, surrounding by a dielectric sheath is disposed in the conductor-receiving passage.

27 Claims, 8 Drawing Sheets

MODULAR SHIELDED CONNECTOR

REFERENCE TO RELATED APPLICATIONS

This is a National Phase Application of PCT/US01/145 12, which is a continuation-in-part of U.S. patent application, Ser. No. 09/565,705 filed May 5, 2000, now U.S. Pat. No. 6,491,545.

FIELD OF THE INVENTION

This invention generally relates to the art of electrical connectors and, particularly, to a modular shielded connectors which use shielded dielectric housing modules.

BACKGROUND OF THE INVENTION

A typical coaxial cable includes a center core conductor surrounded by a tubular-like dielectric sheath which, in turn, is surrounded by a shield which typically is a cylindrical metallic braid. A dielectric cover may surround the braid. The braid is used for both shielding and grounding purposes.

A wide variety of connectors are available for terminating and/or interconnecting coaxial cables. Such a connector typically includes some form of dielectric housing having at least one through passage for receiving a coaxial cable. At least portions of the housing are covered by a conductive shielding member, and appropriate mounting means are provided for securing the shielding member to the housing. The coaxial cable typically is "stripped" to expose the shielding braid thereof. The braid is coupled to the shield of the connector. For instance, the braid may be soldered to the connector shield, and/or the braid may be soldered to a separate grounding member of the connector.

In addition, many electronic devices, such as computers, include transmission lines to transmit signals from peripheral devices such as a video cameras, compact disc players or the like to the motherboard of the computer. These transmission lines incorporate signal cables that are capable of high-speed data transmissions. In most applications, the signal cable extends from either the peripheral device itself or a connector on the peripheral device to a connector mounted on the motherboard. Signal cable construction may use what are known as one or more differential pairs of conductors. These differential pairs typically receive complementary signal voltages, i.e., one wire of the pair may see a +1.0 volt signal, while the other wire of the pair may see a −1.0 volt signal. As signal cables are routed within a computer, they may pass by or near electronic devices on the computer motherboard which create their own electric field. These devices have the potential to create electromagnetic interference to transmission lines such as the aforementioned signal cables. However, this differential pair construction minimizes or diminishes any induced electrical fields and thereby eliminates electromagnetic interference.

Prior art connectors having housing modules include U.S. Pat. No. 5,354,219 and European Patent Application EP 0 852 414 A2.

With the ever-increasing miniaturization and high density of contemporary electrical circuitry, coral cables have become quite difficult to manufacture and use due to the complexity of the connectors. These manufacturing difficulties have prevented these connectors from entering many markets where high position counts are needed. The present invention solves these problems by providing a modular shielded coaxial cable connector using a split housing of dielectric modules plated with a conductive shielding material. This allows 100 plus position count coaxial cable connectors to be feasible. Moreover, this modular concept can also be used to modularize other types of connectors, such as differential signal pair connectors.

SUMMARY OF THE INVENTION

An object, therefore, of the invention is to provide a new and improved modular shielded coaxial cable connector.

In the exemplary embodiment of the invention, the connector includes at least a pair of dielectric housing modules defining at least one cable-receiving passage therebetween. The passage is split axially whereby a passage portion is disposed in each housing module. The housing modules are plated with conductive shielding material at least in the area of the split passage. A coaxial cable section is disposed in the cable-receiving passage. The cable section includes a conductive core surrounded by a dielectric sheath.

As disclosed herein, a plurality of the split cable-receiving passages are provided between the housing modules. The passages are substantially equally spaced. In one embodiment of the invention, each passage is split generally along a centerline thereof, whereby a passage-half is disposed in each housing module. Other embodiments contemplate that the passage split is not along a centerline of the dielectric housing module.

In one embodiment of the invention, the split cable-receiving passages extend at angles (e.g., right angled passages). The passages are coplanar, and the passages are split in a plane coextensive with their respective angle. In another embodiment of the invention, each split cable-receiving passage extends at an angle and the passage is split in a direction generally perpendicular to the plane of the angle.

The invention contemplates that a plurality (more than two) of dielectric housing modules can be provided in a stacked arrangement. Each pair of adjacent housing modules has at least one of the split cable-receiving passages therebetween. In another embodiment of the invention, the modular shielded coaxial cable connector is generally circular, with each of the housing modules being generally pie-shaped.

In yet another embodiment of the invention, the housing modules have regions between the split cable-receiving passages having electrical isolation regions to provide for electrical isolation between the cable-receiving passages.

In yet another embodiment of the invention, the conductor-receiving passages are designed to receive differential pairs of signal conductors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENTS

Figure 1:
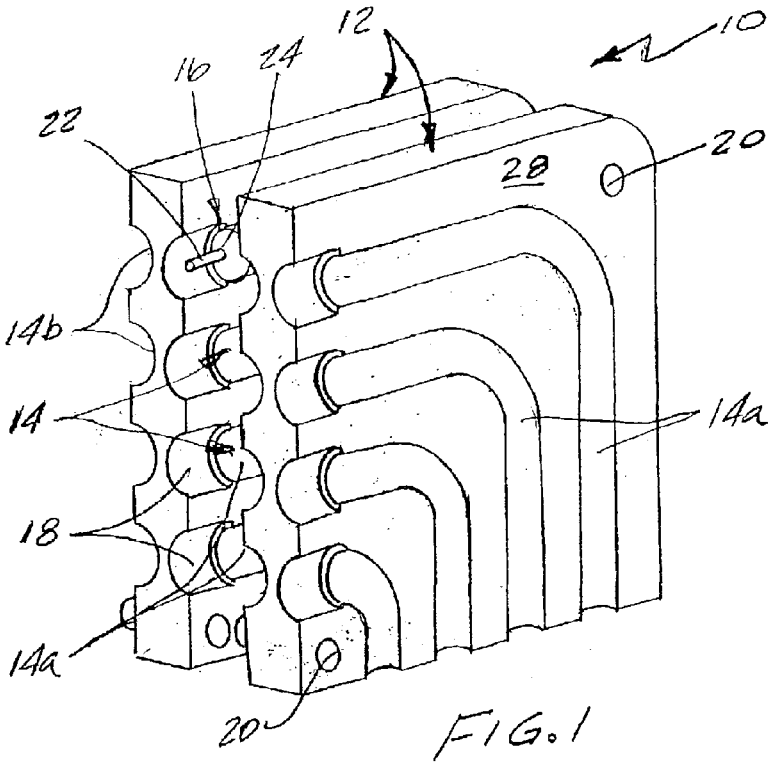
FIG. 1 is perspective view of one embodiment of a modular shielded coaxial cable connector.

Referring to the drawings in greater detail, and first to FIG. 1, a first embodiment of a modular shielded coaxial cable connector, generally designated 10, is shown according to the invention. The connector includes at least a pair of plated housing modules, generally designated 12, defining a plurality of cable-receiving passages, generally designated 14, therebetween. A coaxial cable section, generally designated 16, is disposed in one or more or all of passages 14. Only one coaxial cable section is shown to avoid cluttering the illustration. Enlarged receptacle areas 18 are provided at one or both of the ends of each passage 14. Although described as a modular shielded coaxial cable connector, it is understood that the invention disclosed herein may also be used with any type of signal conductor.

Figure 9:
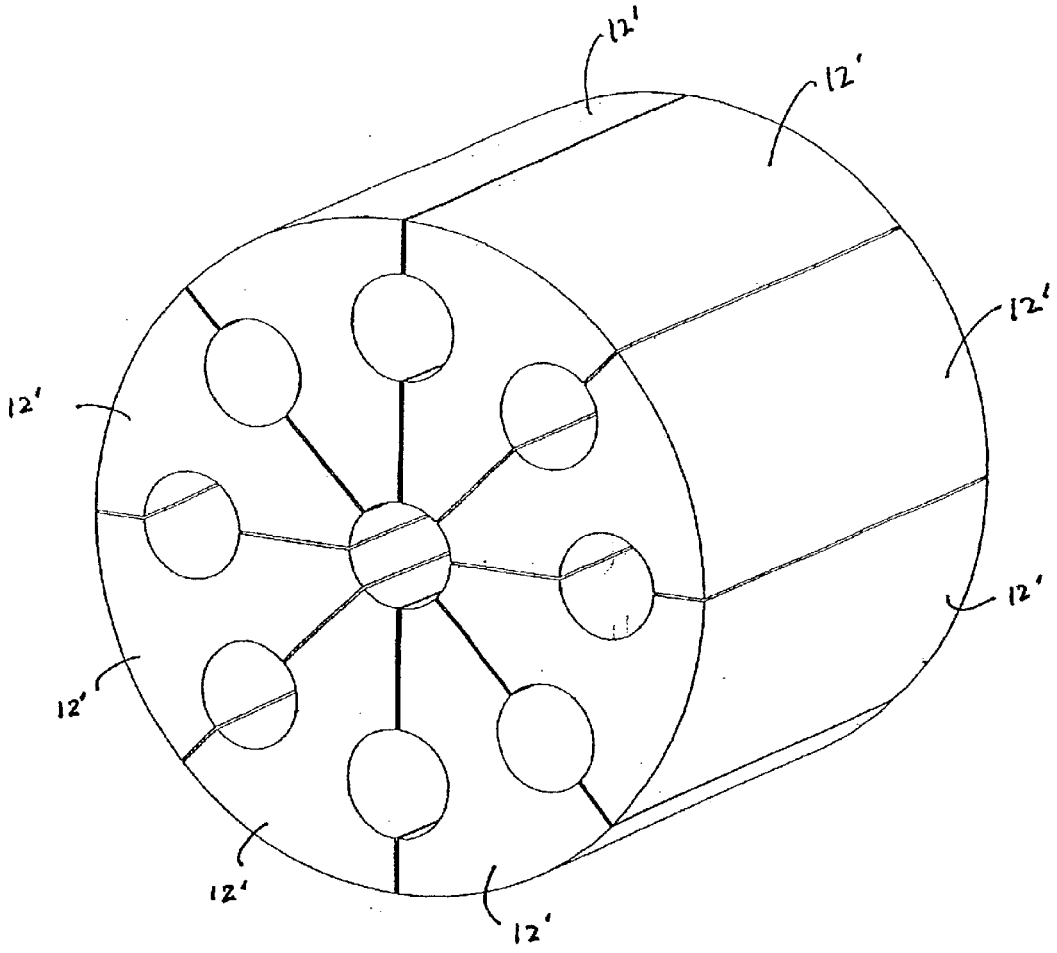
FIG. 9 is a perspective view of an alternative embodiment (circular) of a modular shielded cable connector.

More particularly, each cable-receiving passage 14 is split axially whereby a passage portion 14*a*, 14*b* is disposed in each housing module 12 for each passage. Preferably, the passages are split generally along centerlines thereof, whereby passage portions 14 comprise passage-halves 14*a*, 14*b* which combine to form the whole passages, although non-centerline split passages are possible (not shown). In addition, the modular shielded coaxial connector may be circular, as illustrated in FIG. 9, with each of the housing modules 12' being generally pie-shaped. FIG. 1 shows housing modules 12 separated to better illustrate the opposing passage-halves and the one coaxial cable section 16. In full assembly, the housing halves are juxtaposed into abutment and held together either by appropriate adhesives or fasteners extending through assembly holes 20.

Each coaxial cable section 16 includes a center conductive core 22 surrounded by a dielectric tubular-like sheath 24. The sheath is stripped as shown in FIG. 1, so that a length of core 22 projects into receptacle area 18 of the respective passage 14. An appropriate female connector (not shown) can be inserted into receptacle area 18.

The invention contemplates that each housing module 12 be molded in its desired configuration. As shown in the embodiment of FIG. 1, the housing modules are generally rectangular (square) thin block-like members. Passage halves 14*a*, 14*b* are molded directly into the opposite faces of the housing modules. The modules can be molded of appropriate dielectric material such as plastic or the like. The entire molded plastic housing modules then are substantially entirely plated with a conductive shielding material. The modules can be plated with a conductive metal in a wet chemical electroless process or other suitable process.

Of course, the invention is not limited to the particular configuration of the housing modules shown in FIG. 1 and a wide variety of configurations are readily apparent. In addition, the invention is not limited to entirely plating the modules, and plating in at least the areas of split passages 14 is contemplated. With the thin modules shown in FIG. 1, and with passage halves 14*a*, 14*b* being molded on both opposite faces of the modules, plating each entire module has been found to be quite efficient.

In the embodiment of FIG. 1, it can be seen quite clearly that cable-receiving passages 14 formed by passage-halves 14*a*, 14*b* are generally coplanar and extend at angles through housing modules 12. Precisely, the passages and passage-halves extend at right-angles and open at adjacent edges of the modules. Therefore, in this embodiment, the passages are split in a plane coextensive with the angle of the passages. In other words, all of the passages between any two adjacent housing modules 12 are in a common plane.

Figure 2:
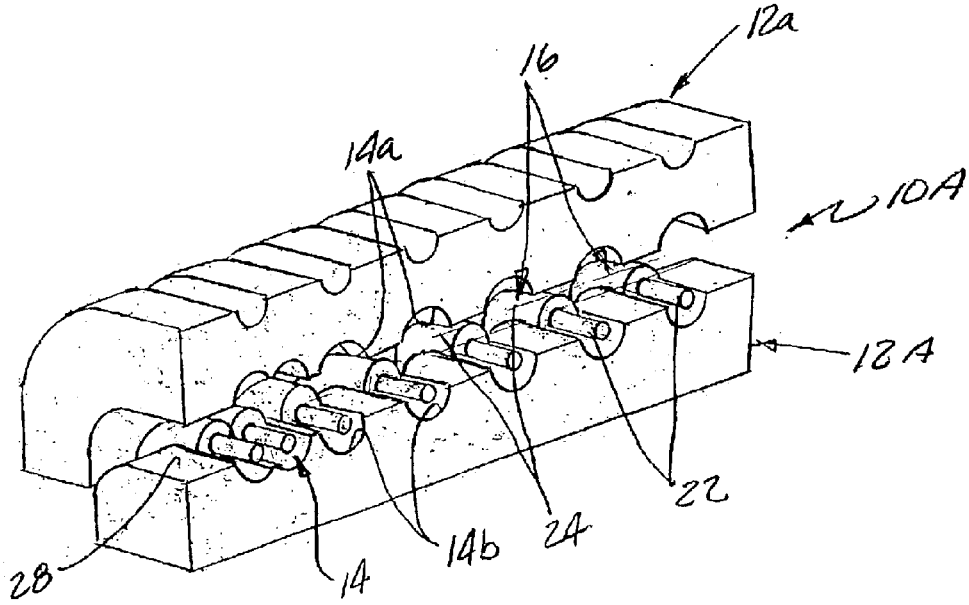
FIG. 2 is a perspective view of another embodiment of the modular shielded coaxial cable connector.

FIG. 2 shows an alternative embodiment of a connector 10A wherein the cable-receiving passages extend between a pair of housing modules 12A at right-angles. However, the passages in connector 10A are split in a direction generally perpendicular to the planes of the angles of the coaxial cables. Other than the configuration of housing modules 12A as seen in FIG. 2, the housing modules are fabricated the same and like reference numerals have been applied in FIG. 2 corresponding to like components described above in relation to the embodiment of FIG. 1.

Figure 3:
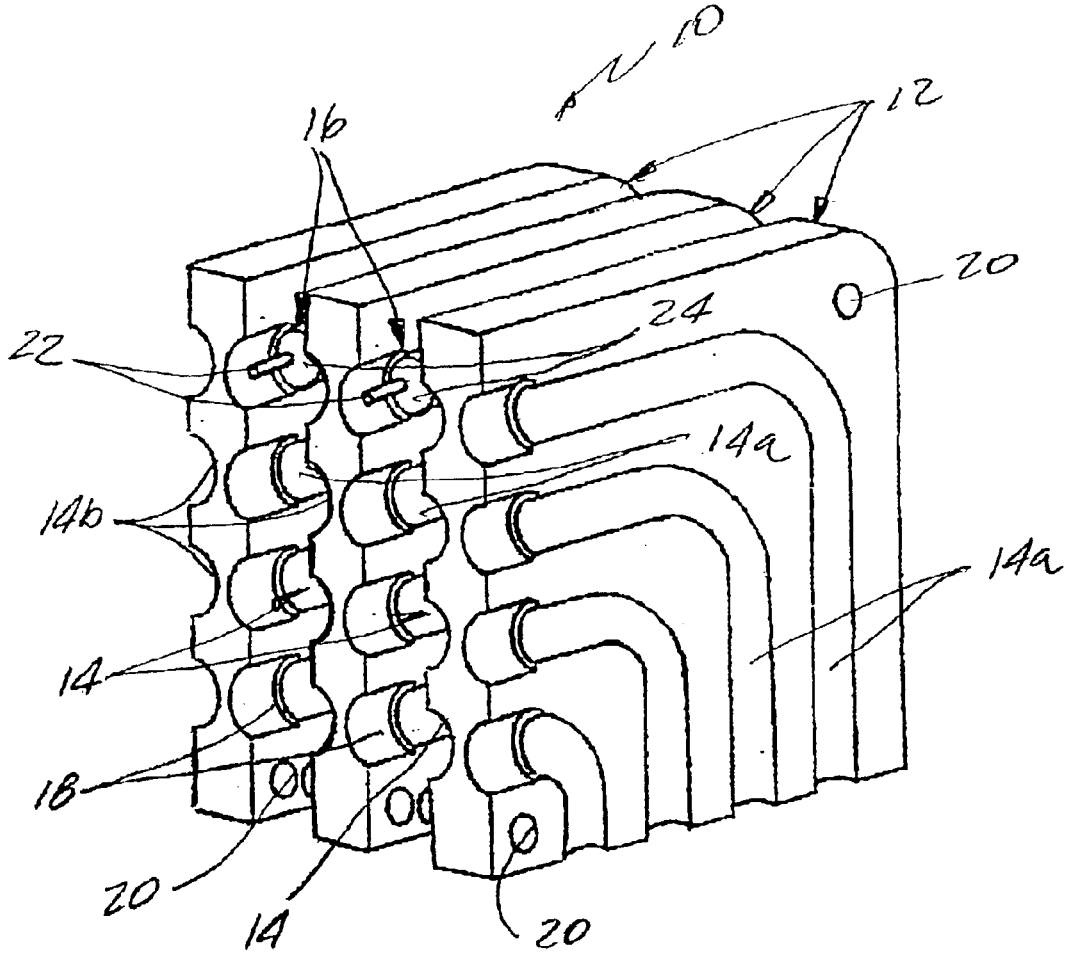
FIG. 3 is a perspective view of the embodiment of FIG. 1, showing that the housing modules can be stacked in considerable multiples.
Figure 4:
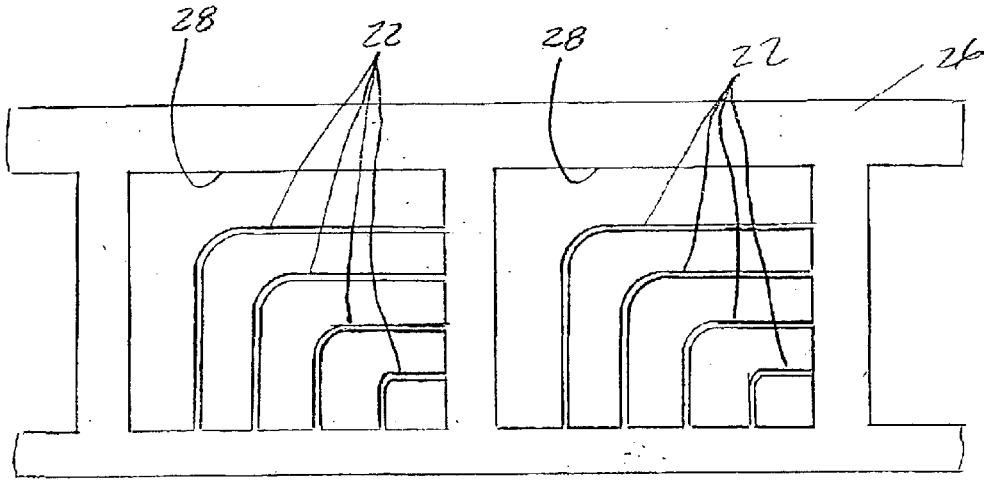
FIG. 4 shows a first step in fabricating one of the housing modules of the embodiment shown in FIGS. 1 and 3, namely stamping the center conductor cores of the coaxial cable sections.

FIG. 3 simply shows the embodiment of FIG. 1 with a third housing module 12 added. This depiction emphasizes that any number of housing modules 12 can be stacked in high density array of coaxial cables 16, with cable-receiving passages 14 formed by passage-halves 14*a*, 14*b* being disposed between each adjacent pair of modules in the stacked array thereof.

Figure 8:
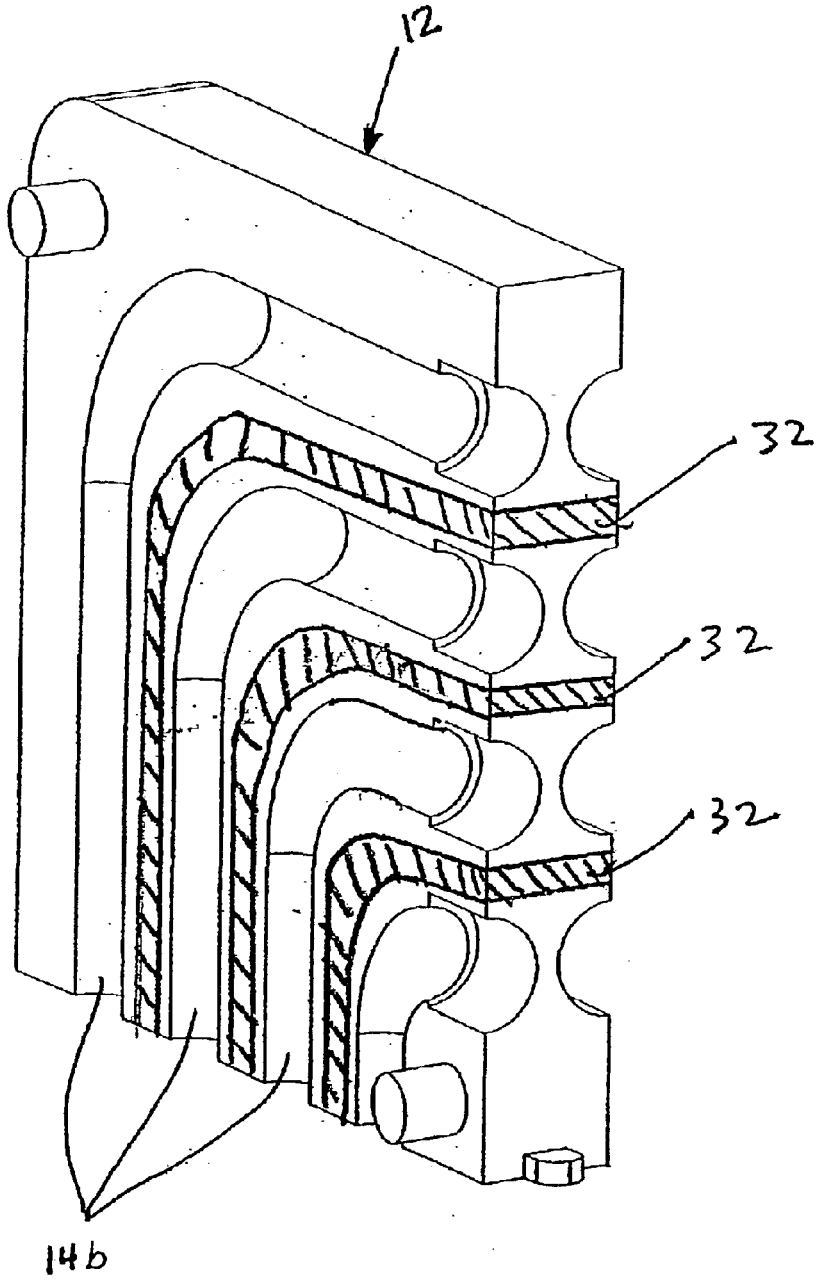
FIG. 8 is a perspective view of the embodiment of FIG. 1, showing electrical isolation between the cable-receiving passages.

In the embodiment shown in FIG. 8, it can be seen that electrical isolation 32 exists between the passage halves 14*a*, 14*b* to provide electrical isolation between the cable-receiving passages. The electrical isolation 32 may take the form of selective non-plating of the housing module 12, although this invention is not limited to only that method of providing electrical isolation between the cable-receiving passages.

FIGS. 4–7 show the steps in fabricating coaxial cable connector 10 to exemplify the simplicity of the connector as well as the ease in manufacturing and assembling the connector. More particularly, referring first to FIG. 4, a sheet 26 of conductive metal material is provided, and conductors 22 are stamped out of openings 28 in a plurality of groupings lengthwise of the sheet which is provided in strip-like form for feeding through an appropriate stamping machine.

Figure 5:
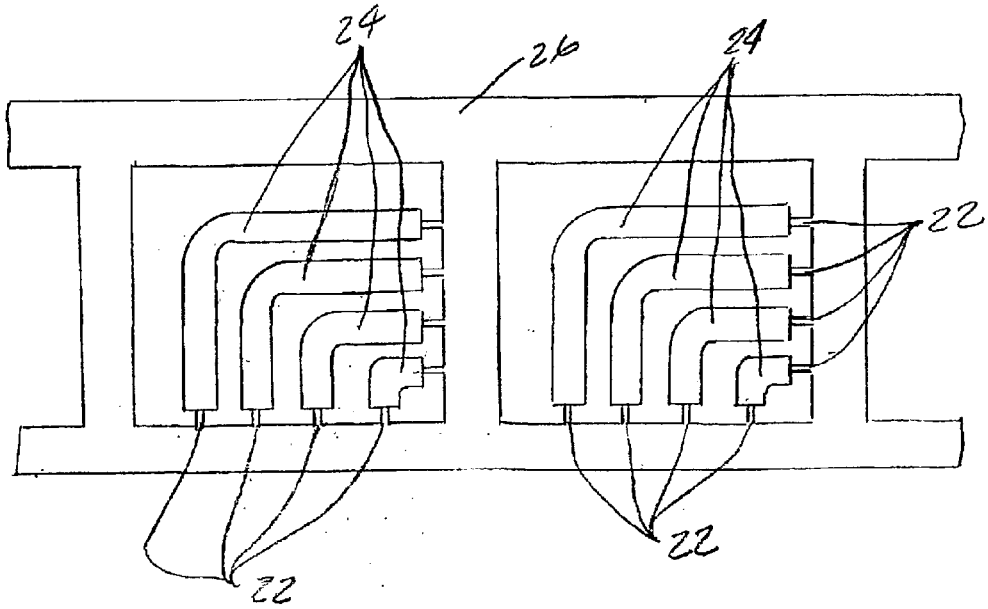
FIG. 5 is a view similar to that of FIG. 4, but showing the conductor cores overmolded with dielectric sheaths.

FIG. 5 shows the next step of overmolding dielectric sheaths 24 about conductive cores 22. This can be easily accomplished by placing stamped sheet 26 (FIG. 4) into an appropriate molding die and overmolding the dielectric sheaths about the conductive cores, as shown.

In a separate operation, housing modules 12 (FIG. 6) are molded as plastic blocks including passage halves 14*a*, 14*b* molded in opposite faces of the blocks, and the plastic blocks then are plated with a conductive shielding material 28, particularly in the area of the passage halves. These molded, plated housing modules can be maintained in inventory and used as needed.

Figure 7:
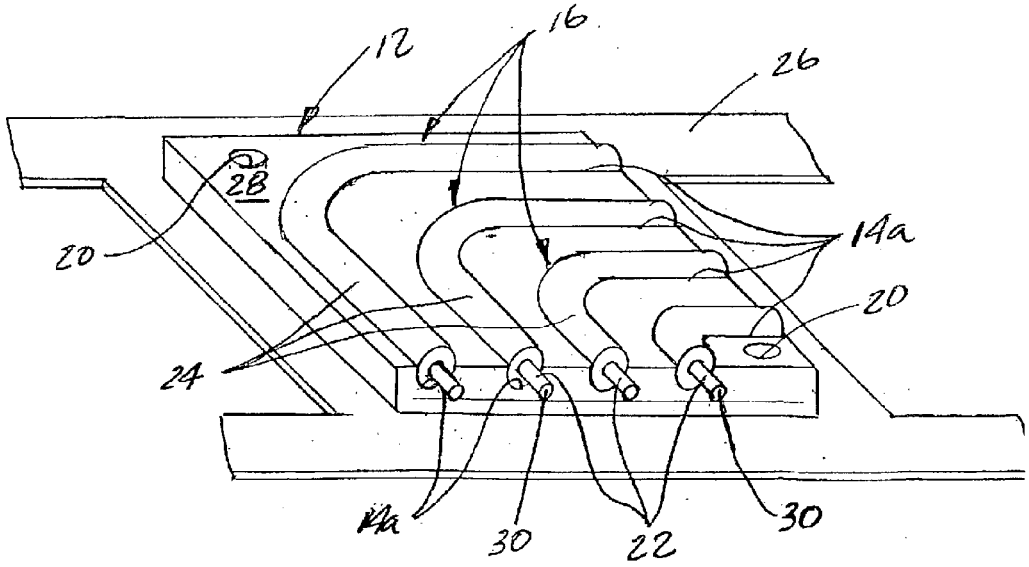
FIG. 7 is a perspective view showing how the coaxial cable sections of FIG. 5 are laid into the housing module of FIG. 6.

FIG. 7 shows the next step in fabricating the coaxial cable connector and includes taking the subassembly of FIG. 5 and laying the subassembly onto one or more of the molded and plated housing modules 12. The subassemblies may be fabricated in a continuous fashion so that the subassemblies can be wound onto a reel. The subassemblies then can be fed to an indexing machine where they are sequentially laid onto housing modules 12 as the modules are fed seriatim to an assembly station. Conductive cores 22 are severed from sheet 26, as at 30, either at the point of assembly to the housing modules or thereafter in the assembly line. Holes 20 also can be punched through the housing module at the same time that the cores are severed from the metallic sheet.

Figure 6:
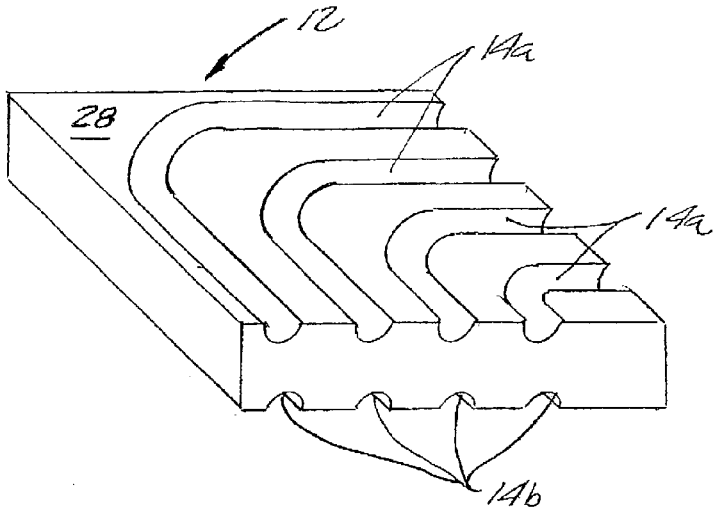
FIG. 6 is a perspective view of one of the plated housing modules.

After the assembly of FIG. 7, various options are available. For instance; a second housing module 12 can be immediately adhered to or fastened to the assembly shown in FIG. 7 to form a connector as shown at 10 in FIG. 1. In the alternative, coaxial cable sections 16 (FIG. 7) can be adhered within passage halves 14*a*, 14*b* and a plurality of these assemblies can be stacked, as desired, in a high density array until a housing module such as shown in FIG. 6 is used as an "end cap" at the end of the stacked array.

Figure 11:
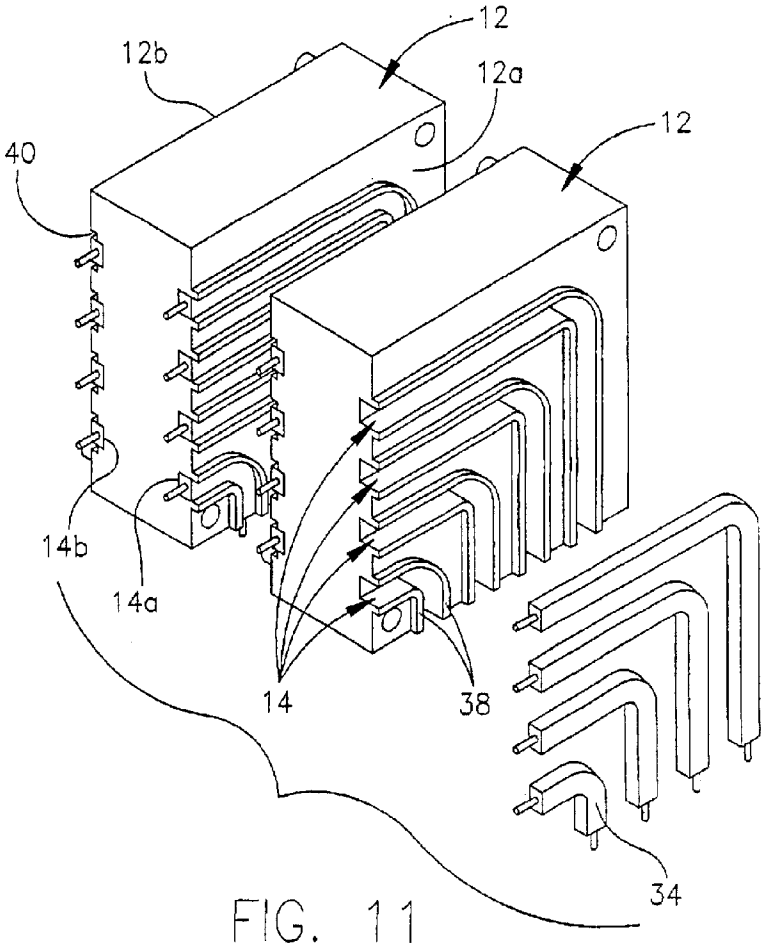
FIG. 11 is an exploded perspective view of an alternate embodiment of the modular shielded connector of FIG. 10.
Figure 10:
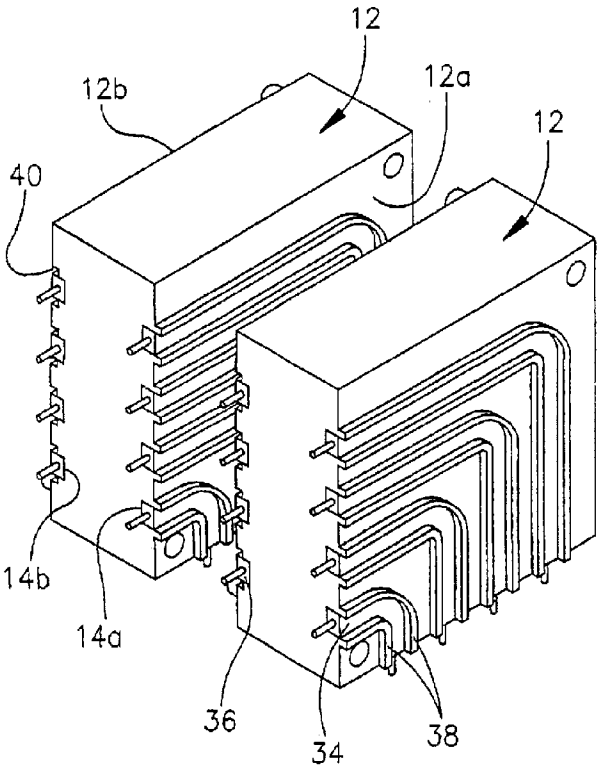
FIG. 10 is a perspective view of an alternative embodiment (differential pair) of a modular shielded connector.

FIGS. 10 and 11 illustrate yet another embodiment of a modular shielded connector. The connector includes at least a pair of plated housing modules, generally designated 12, defining a plurality of conductor-receiving passages, generally designated 14*a* and 14*b*, on either side 12*a*, 12*b* of the housing modules 12. Conductor-receiving passages 14*a* receive one of the conductors 34 that forms the differential signal pair while conductor-receiving passages 14*b* receives the other of the conductors 36 that form the differential signal pair. By separating the differential signal pair, the differential signal conductors 34, 36 do not extend beyond the sidewalls 12*a*, 12*b* of the housing modules 12. Housing modules 12 may also include a tongue 38 on one sidewall 12*a* and a groove 40 on the other sidewall 12*b* to allow the modular housing modules to be easily aligned with each other to maximize the performance of the differential signal pairs.

Figure 13:
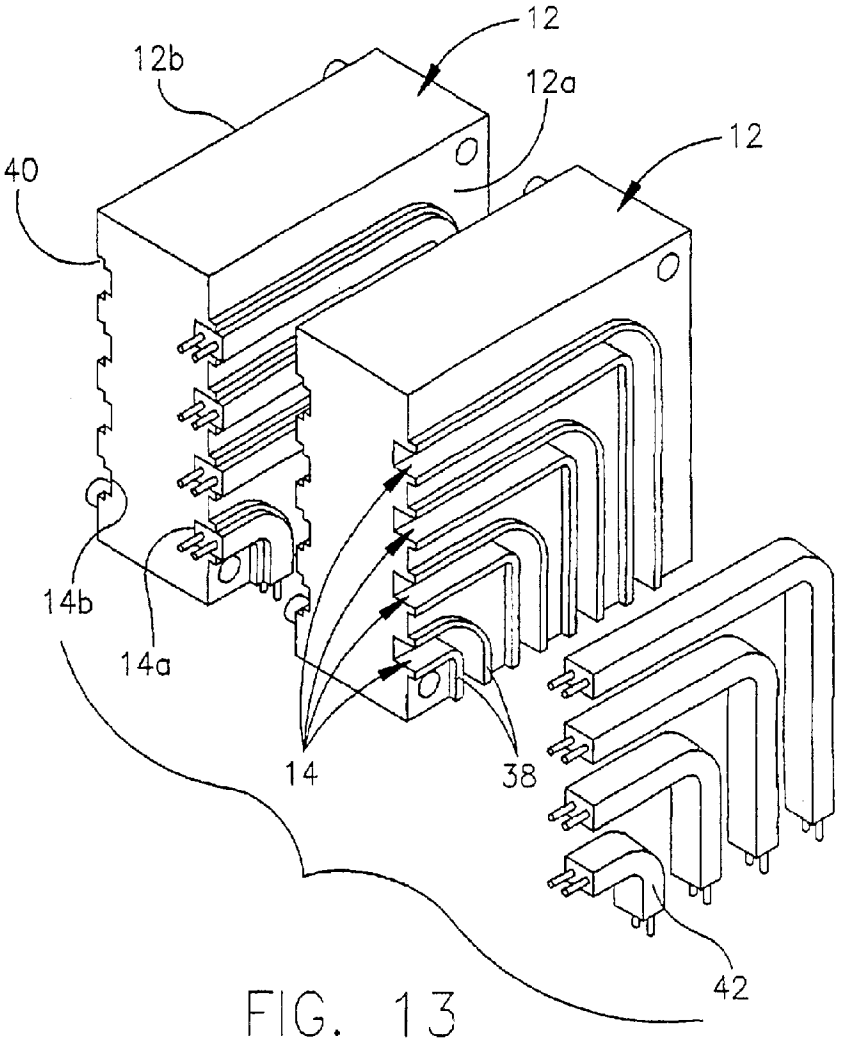
FIG. 13 is an exploded perspective view of an alternate embodiment of the modular shielded connector of FIG. 12.
Figure 12:
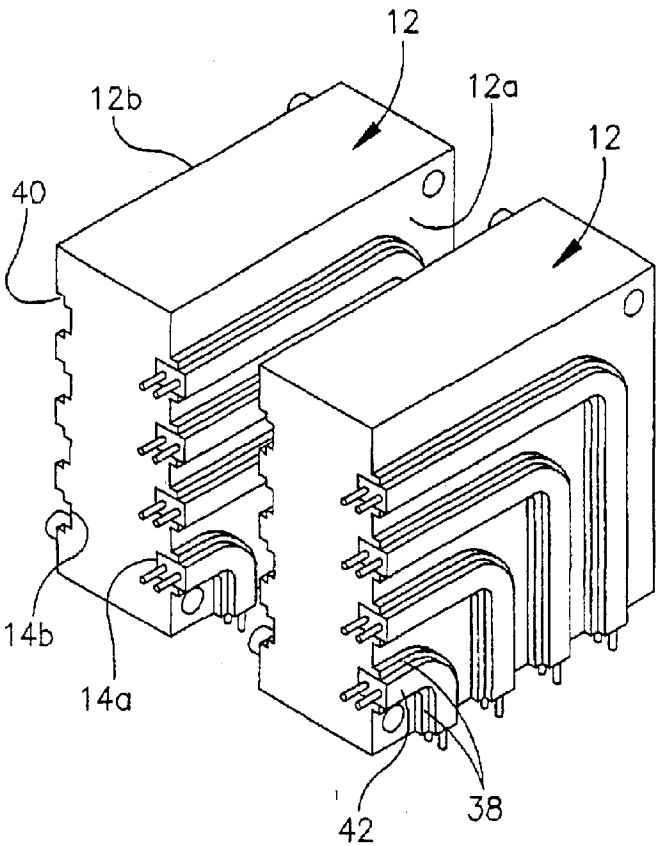
FIG. 12 is a perspective view of an alternative embodiment (using a differential pair) of a modular shielded connector.

The embodiment illustrated in FIGS. 12 and 13 is similar to that of FIGS. 10 and 11, except that the differential signal pair 42 is not separated into individual conductors 34, 36 as in FIGS. 10 and 11. In such an embodiment, the differential signal pair 42 is inserted into one of the conductor-receiving passages 14*a*, resulting in the differential signal pair 42 extending beyond the sidewall 12*a* of the housing module. That portion of the differential signal pair 42 that extends beyond the sidewall 12*a* of the housing module is received in the conductor-receiving passage 14*b* of the adjacent housing module 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A modular shielded connector (10), comprising at least a pair of dielectric housing modules (12) defining at least one conductor-receiving passage (14) therebetween, the passage (14) being split axially whereby a passage portion (14*a*, 14*b*) is disposed in each housing module (12), and a conductor (16) disposed in the conductor-receiving passage (14), the conductor (16) including a conductive core (22) surrounded by a dielectric sheath (24), characterized in that:

the housing modules (12) are plated with conductive shielding material at least in the area of the split passage (14).

2. The modular shielded connector (10) of claim 1, wherein the conductor-receiving passage (14) is split generally along a centerline thereof, whereby a passage-half (14*a*, 14*b*) is disposed in each housing module (12).

3. The modular shielded connector (10) of claim 1, including a plurality of the split conductor-receiving passages (14) between the housing modules (12).

4. The modular shielded connector (10) of claim 3, wherein the plurality of split conductor-receiving passages (14) are nonlinear and equally spaced.

5. The modular shielded connector (10) of claim 1, wherein the split conductor-receiving passage (14) extends at an angle and the passage is split in a plane coextensive with the angle.

6. The modular shielded connector (10) of claim 5, wherein the conductor-receiving passage (14) is split generally along a centerline thereof, whereby a passage-half (14*a*, 14*b*) is disposed in each housing module (12).

7. The modular shielded connector (10) of claim 1, wherein the split conductor-receiving passage (14) extends at an angle and the passage is split in a direction generally perpendicular to the plane of the angle.

8. The modular shielded connector (10) of claim 7, wherein the conductor-receiving passage (14) is split generally along a centerline thereof, whereby a passage-half (14*a*, 14*b*) is disposed in each housing module (12).

9. The modular shielded connector (10) of claim 1, wherein the dielectric housing modules (12) are substantially entirely plated with the conductive shielding material.

10. The modular shielded connector (10) of claim 1, wherein at least one of the housing modules (12) has the passage portion (14*a*) on one side thereof and includes a passage portion (14*b*) on an opposite side thereof for cooperation with a third housing module to form a stacked connector.

11. The modular shielded connector (10) of claim 1, wherein the housing modules (12) are generally pie-shaped.

12. The modular shielded connector (10) of claim 1, wherein the conductor (16) is a coaxial cable section disposed in the conductor-receiving passage (14), the cable section including a conductive core (22) surrounded by a dielectric sheath (24).

13. The modular shielded connector (10) of claim 1, wherein the conductor (16) is a differential signal pair (34, 36).

14. The modular shielded connector (10) of claim 1, wherein the housing modules (12) have opposing sidewalls (12*a*, 12*b*), and wherein a passage-half (14*a*, 14*b*) is disposed on each of the opposing sidewalls (12*a*, 12*b*).

15. The modular shielded connector (10) of claim 14, wherein each of the passage-halves (14*a*, 14*b*) includes one conductor of a differential signal pair (34, 36).

16. The modular shielded connector (10) of claim 14, wherein a differential signal pair (34, 36) is received within the passage-half (14*a*, 14*b*) of one of the opposing sidewalls (12*a*, 12*b*).

17. A modular shielded connector housing comprising at least a pair of dielectric housing modules (12) defining at least one conductor-receiving passage (14) therebetween, the passage (14) being split axially whereby a passage portion (14*a*, 14*b*) is disposed in each housing module (12), characterized in that:

the housing modules (12) are plated with conductive shielding material at least in the area of the split passage (14).

18. The modular shielded connector housing of claim 17, wherein the conductor-receiving passage (14) is split generally along a centerline thereof whereby a passage-half (14*a*, 14*b*) is disposed in each housing module (12).

19. The modular shielded connector housing of claim 17, including a plurality of the split conductor-receiving passages (14) between the housing modules (12).

20. The modular shielded connector housing of claim 19, wherein the plurality of split conductor-receiving passages (14) are nonlinear and equally spaced.

21. The modular shielded connector housing of claim 17, wherein the split conductor-receiving passage (14) extends at an angle and the passage is split in a plane coextensive with the angle.

22. The modular shielded connector housing of claim 21, wherein the conductor-receiving passage (14) is split generally along a centerline thereof, whereby a passage-half (14*a*, 14*b*) is disposed in each housing module (12).

23. The modular shielded connector housing of claim 17, wherein the split conductor-receiving passage (14) extends at an angle and the passage is split in a direction generally perpendicular to the plane of the angle.

24. The modular shielded connector housing of claim 23, wherein the conductor-receiving passage (14) is split generally along a centerline thereof, whereby a passage-half (14*a*, 14*b*) is disposed in each housing module (12).

25. The modular shielded connector housing of claim 17, wherein the dielectric housing modules (12) are substantially plated with the conductive shielding material.

26. The modular shielded connector housing of claim 17, wherein at least one of the housing modules (12) has the passage portion (14*a*) on one side thereof and include a passage portion (14*b*) on an opposite side thereof for cooperation with a third housing module to form a stacked connector.

27. The modular shielded connector housing of claim 17, wherein the housing modules (12) are generally pie-shaped.

* * * * *